United States Patent [19]

Lawrence et al.

[11] 3,959,633

[45] May 25, 1976

[54] SECURITY GUARD RECORDING SYSTEM

[75] Inventors: William Grove Lawrence, Santa Ana; Wolfgang Juergen Sauter, Fountain Valley, both of Calif.

[73] Assignee: Merck & Co., Inc., Rahway, N.J.

[22] Filed: Sept. 10, 1974

[21] Appl. No.: 504,764

[52] U.S. Cl. ..... 235/92 T; 235/61.11 E; 235/61.7 B; 340/149 R; 340/306; 346/52

[51] Int. Cl.[2] ..... G08B 29/00

[58] Field of Search ..... 340/149 A, 306, 172.5; 235/61.7 B, 61.11 E, 61.6 H, 92 T; 346/60, 52

[56] References Cited

UNITED STATES PATENTS

| | | | |
|---|---|---|---|
| 3,419,881 | 12/1968 | Yamamoto et al. | 340/149 A |
| 3,457,391 | 7/1969 | Yamamoto | 235/61.7 B |
| 3,582,617 | 6/1971 | Berler | 235/61.11 E |
| 3,593,008 | 7/1971 | De Witt et al. | 235/92 T |
| 3,688,088 | 8/1972 | Brown et al. | 235/61.7 B |
| 3,736,561 | 5/1973 | Rumpel | 340/306 |
| 3,757,089 | 9/1973 | Hockler | 340/149 A |
| 3,781,845 | 12/1973 | Ellul | 340/149 R |

*Primary Examiner*—Leo H. Boudreau
*Attorney, Agent, or Firm*—Harry E. Westlake, Jr.; Rudolph J. Anderson, Jr.; Martin L. Katz

[57] ABSTRACT

A watchman's tour recording system which includes a watchman's unit having a clock means for producing digital time signals, a station identification signal producing means for producing digital station signals, at least two digital bit storage or memory means and special address means arranged to direct the digital time and station identification signals into predetermined locations in the memory means so that their storage capabilities are most effectively utilized. Novel photoelectric station identification signal generating means are also disclosed.

19 Claims, 6 Drawing Figures

TERMINAL STATION
WATCHMAN'S UNIT
PRINTOUT OF TOUR PLAN REPORT
START TOUR
DATA ACCEPTED
INITIALIZATION FINISHED
BUSY
INPUT OK
FINISH TOUR
TERMINAL
COMPUTER
TOUR STORAGE BANK

SECURITY GUARD RECORDING SYSTEM

BACKGROUND OF THE INVENTION

1. Field of the Invention

This invention relates to security systems and more particularly it concerns novel arrangements for recording and checking security tours made by watchmen.

2. Description of the Prior Art

In carrying out security checking operations in factories or other commercial establishments, watchmen usually follow a prearranged tour so that critical areas are checked at predetermined intervals and so that a complete coverage of the premises can be ensured. It is important for insurance and other purposes to have a record made of the watchman's tour. In the past this was obtained by providing the watchman with a self-contained recording unit which included a clock and a disc shaped paper which was rotated by the clock. The recording unit was "punched" or connected to special station keys at preselected locations along the watchman's tour. As each punch was made, the key would make an impression on the paper disc. This impression was in the form of a symbol which corresponded to the identity of the station; and the location of the symbol on the disc, which was rotated by the clock, would correspond to the time that station was checked. After the tour had been completed, the paper disc would be removed from the unit and replaced by a new one. By noting the symbols and their locations on the disc, it was possible to ascertain what stations were checked and at what times and in what order they were checked.

While this system provided a permanent record of the watchman's tour, it was limited, from a practical standpoint, to relatively simple tours involving a small number of stations. Where a greater number of stations are involved the process of checking the recorded discs becomes very time consuming and subject to error. Also, the system does not lend itself to the checking of multiple tours, nor is it readily adaptable to tour modifications.

It has been proposed to utilize electronic means and a computer system to overcome the above described limitations of the conventional watchman's clock system. Such proposals are found, for example, in U.S. Pat. Nos. 1,919,007; 2,275,981; 2,308,198; 2,734,791; 3,237,183; 3,371,349 and 3,736,561. These electronic means, however, involved the wiring of each station to be checked to a central computer. While these electronic systems would produce an instantaneous computer readable indication of each station check made by a watchman, they suffer from the disadvantage that the wiring involved makes them quite expensive. Also, a wired system does not lend itself to tour modification.

In another invention, described and claimed in U.S. application Ser. No. 504,765 filed, Sept. 10, 1974 it is possible to provide one or several tours convering a great number of stations; and these tours may be reported and checked accurately and rapidly with computer means.

According to the last mentioned invention there is provided a tour recording arrangement which is carried in a watchman's unit. This tour recording arrangement includes a clock signal producing means, a station identification signal producing means, a signal storage or memory device and means for directing corresponding clock and station identification signals to predetermined locations in the memory device each time the watchman connects the unit to a station being checked. Unlike the clock rotated paper disc units of the prior art, the clock signals in this last mentioned invention are recorded as actual data in predetermined locations in the memory device. Thereafter, at the end of a tour the watchman's unit may simply be plugged into a terminal and the data stored in its memory device can be read out to provide a complete, accurate and instantaneous report of the tour along with an indication of missed or improperly checked stations or stations checked at the wrong time.

According to one embodiment of this last mentioned invention, the station identification signals direct the clock signals to corresponding locations in the memory device. In another embodiment, the memory device is of sufficient capacity to receive and store both clock signals and station identification signals. In this second embodiment there are provided sequencing means which, upon each station check directs the station identification and clock signals to corresponding locations in the memory device.

SUMMARY OF THE INVENTION

The present invention provides improvements which are useful in connection with the invention of U.S. application Ser. No. 504,765. According to one aspect of the present invention there are provided novel check stations and watchman's unit arrangements for generating digital code signals representing the identity of a station to be checked. These novel arrangements include a light source extending along one side of a slot in a watchman's unit and a plurality of photocells positioned along the opposite side of the slot and facing the light source. These photocells are individually capable of producing electrical signals on associated output terminals when exposed to light from the light source. A card is provided at each station to be checked; and this card has a series of holes, which, when the card is filled into the slot in the watchman's unit, extend between the photocells and the light source in alignment with each photocell. Some of the holes are filled with a light transparent substance and others are filled with a light opaque substance according to a pattern which corresponds to the station's identity. When the card is inserted into the slot in the watchman' s unit, the light source turns on and those photocells which are aligned with the light transparent holes in the card become energized to produce signals while the other photocells remain unenergized. This arrangement avoids mechanical contact between electrical parts of the card and the watchman's unit so that wear is reduced and reliability is increased.

According to another aspect of the invention there are provided novel signal storage and processing arrangements within a watchman's unit which permits maximum use of the storage capacity of memory units used in the system. More particularly, storage unit address means are scanned in synchronism with registers containing station identification and time data words; and means are provided to continue the storage scan while the registers are scanned repeatedly as successive station checks are made. The present invention, in this aspect, comprises a first signal storage means, and a station input device responsive upon connection to a station to store station identity signals in the first signal storage means. There is also provided a second signal storage means having a plurality of digital bit locations for storing digitally coded information as well as digital clock means operative to produce a series of timed pulses. Time data means are provided comprising a register for accumulating the digital clock pulses and for energizing plural output terminals in patterns corresponding to the number of accumulated pulses. Time data decoding means are connected to these output terminals. The time data decoding means has a time data output terminal connected to the second signal storage means and the time data decoding means operates in response to each of successively applied pulses to pass the signals present at a different one of the register output terminals through the time data output terminal for application to the second signal storage means. Address means are connected to the second signal storage means and are operative in response to each of successively applied pulses to render a different one of the digital bit locations in the signal storage means receptive to applied time data signals. Finally, means are provided for applying pulses to operate the time data decoding means and address means in synchronism when the unit is connected to a station.

There has thus been outlined broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis of the designing of other methods and structures for carrying out the purposes of this invention. It is important, therefore, that this disclosure be regarded as including such equivalent constructions as do not depart from the spirit and scope of the invention.

BRIEF DESCRIPTION OF THE DRAWINGS

A preferred embodiment of the invention has been chosen for purposes of illustration and description, and is shown in the accompanying drawings forming a part of the specification, wherein.

DESCRIPTION OF THE PREFERRED EMBODIMENTS

Figures 1, 2, 3:
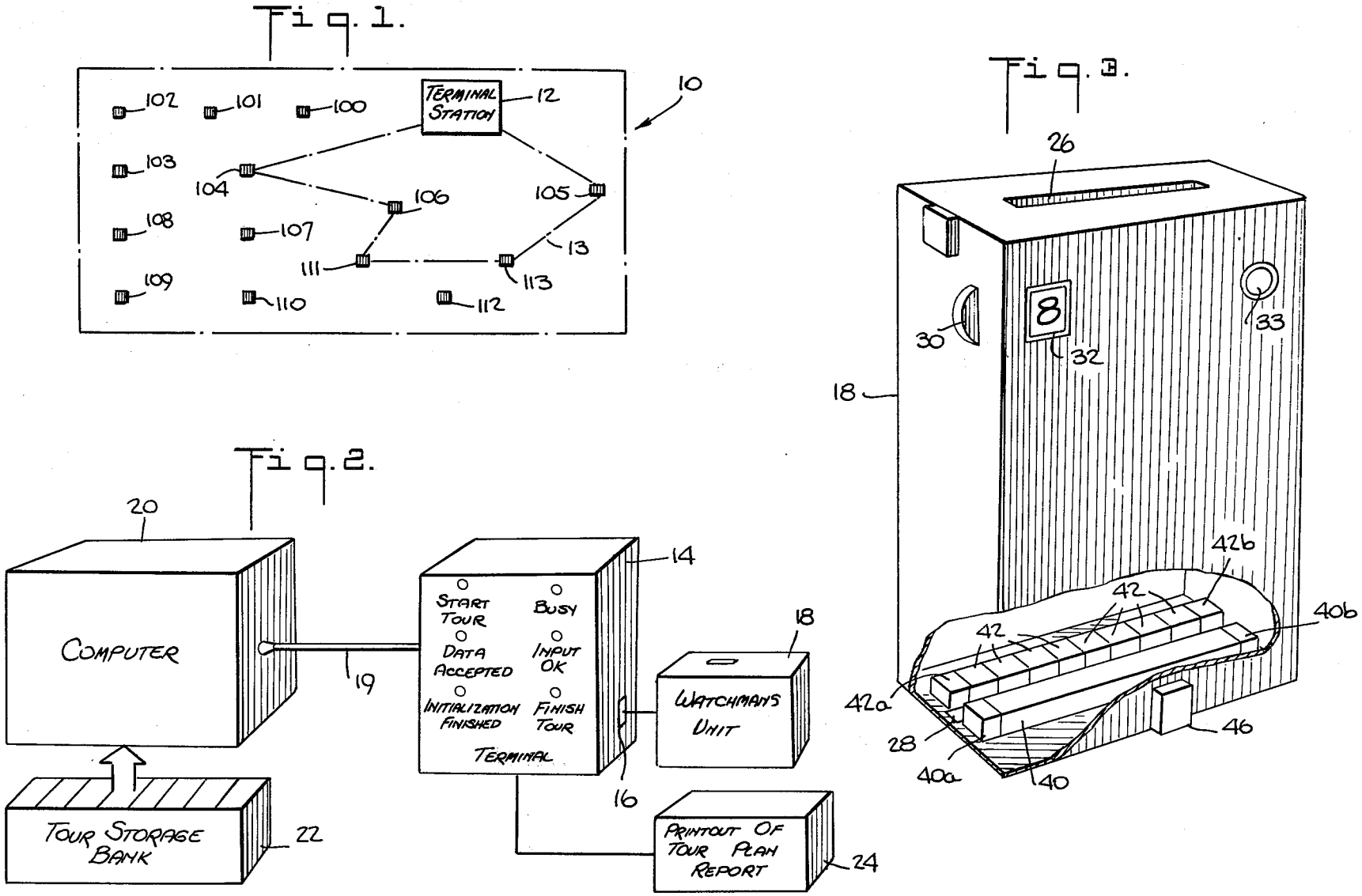
FIG. 1 is a diagrammatic representation of a watchman's tour route in which the present invention is utilized.
FIG. 2 is a block diagram showing a computer, computer terminal and watchman's unit in which the present invention is embodied.
FIG. 3 is a perspective view of the watchman's unit in which the present invention is embodied.

In FIG. 1, a premises to be protected is indicated schematically by an outline 10. Within the premises there is provided a terminal station 12 from which various guard tours start and end. Also within the premises are several check stations 100–113. The number and location of these stations is preselected in accordance with the particular security requirements of the premises.

In conducting a tour, a watchman begins at the terminal station 12; and then he walks along a preassigned route, as indicated by the dashed lines 13, to preselected ones of the check stations. At each station the watchman connects a station key to a watchman's unit which he carries with him. This provides a recording in the watchman's unit of the time and station identifying of each check which he makes.

The number of stations to be checked in each tour, the order in which stations are checked and the times they are to be checked are established before the watchman's tour begins. For the purpose of maximizing security within the premises, the tour routes are changed periodically. It is the ability to adapt to various tour changes which constitutes one important feature of the present invention.

Upon completion of his tour the watchman returns to the terminal station 12 where, as shown in FIG. 2, there is provided a terminal board 14 having a connector plug 16 thereon. A watchman's unit 18 is shown connected to the terminal board 14 via the connector plug 16. When the watchman completes his tour he connects his unit 18 to the terminal board 14; and the data representative of the stations checked and the time of each check made during the tour is fed from the watchman's unit 18 into the terminal board 14. The terminal board 14 is shown to be connected via a cable 19 to a central computer 20. This computer may be remotely located or it may be located at the terminal station 12. A tour storage bank 22 is provided in association with the computer 20. The tour storage bank 22 contains information representative of the stations to be checked for each of several predetermined tours. When a watchman's unit 18 is connected to the terminal board 14 to feed actual tour data through the board into the computer 20, ideal data for that particular tour is also fed into the computer from the tour storage bank 22. The actual tour data and the ideal tour data are compared in the computer and any discrepancies which exist are noted and reported. This report may take the form of a printout at the terminal board 14 as indicated at 24 in FIG. 2.

The watchman's unit 18 is a smaller electronic device which, as shown in FIG. 3, externally resembles a small portable radio. The unit is provided on the top thereof with a terminal connector slot 26 and, on the bottom thereof a station connector slot 28 into which various plugs, such as the connector plug 16 on the terminal board 14 and corresponding plugs at the various stations 100–113 are inserted for reading data into and out from the unit. The unit 18 is also provided with a switch dial 30 which may be turned to any of several positions corresponding to different tours to which the unit may be assigned. A tour identification number, corresponding to the setting of the dial switch 30 appears at a window 32 at the side of the unit. An operation light 33 is also provided on one side of the unit 18 to indicate when data transferred into or out from the unit is complete.

In carrying out a tour, a watchman proceeds from the terminal station 12 and follows a route corresponding to the tour to which his unit 18 has been set. This tour requires that the watchman be present at particular ones of the check stations 100–113 at predetermined times. The presence of the watchman at each station is recorded in his unit when he inserts a station plug into the station connector slot 28 of the unit 18.

As shown in FIG. 3, there is provided inside the watchman's unit 18 a light source 40 extending along one side of the station connector slot 28 and a plurality of photocells 42 distributed along the other side of the slot. A pair of connector switch photocells 42*a* and 42*b* are provided, one at each end of the line of photocells 42. Also, there are provided pulsing light sources 40*a* and 40*b* at each end of the light source 40 in alignment with the connector switch photocells 42*a* and 42*b* respectively. A guide lug 46 is also provided near the lower edge of the unit to prevent improper placement of station keys in the slot.

Figure 4:
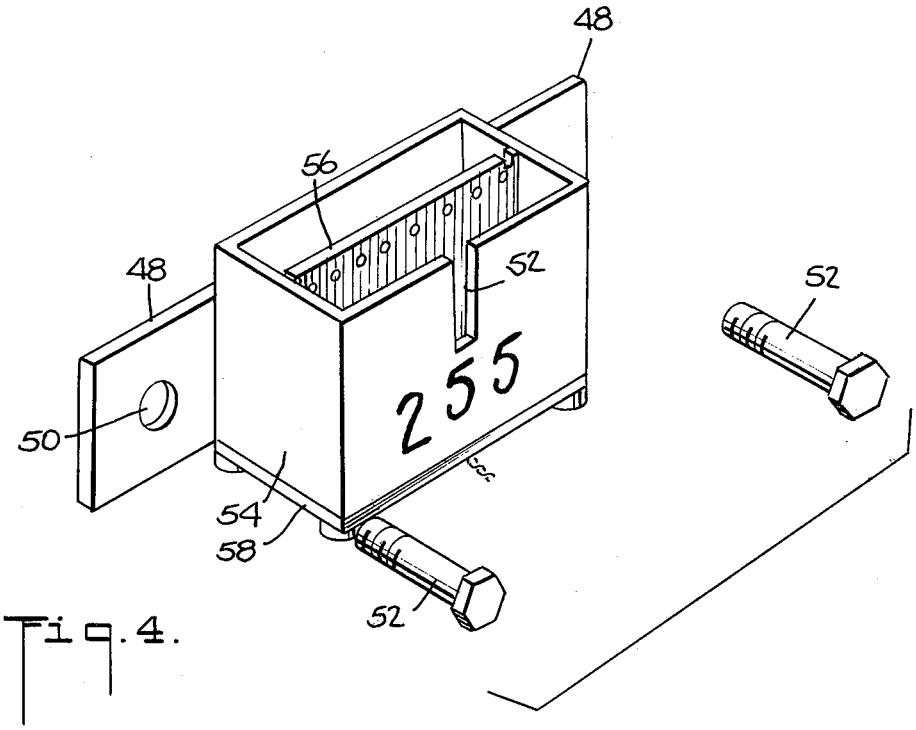
FIG. 4 is a partially exposed perspective view showing the exterior of a station to be checked by the watchman's unit of FIG. 3.

FIG. 4 shows a station connector key arrangement for checking by the watchman's unit 18. This station key arrangement comprises a base plate 48 having holes 50 near each end through which bolts or rivets 52 pass to anchor the arrangement to a structural member or other solid anchor means at a predetermined location in the premises to be checked. A box-like housing 54 is attached to the base plate 48. This housing is opened at the top and is shaped to allow the lower end of the unit 18 to fit down into it. The front side of the housing 54 is notched at 55 to accomodate the guide lug 46 of the watchman's unit. An identification numeral may be printed on the front of the housing for visual identification of the station.

Figure 5:
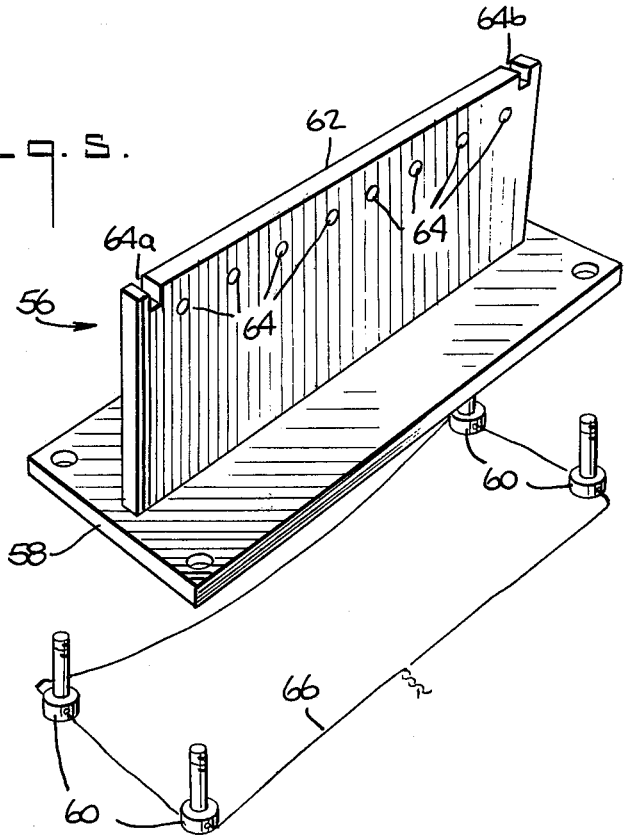
FIG. 5 is a partially exposed perspective view showing the interior of the station of FIG. 4.

FIG. 5 shows a station connector assembly 56 which fits into the bottom of the box-like housing 54 of FIG. 4. The connector assembly 56 includes a horizontal bottom plate 58 which fits up against and closes the bottom of the housing 54. The bottom plate 58 is held in place by means of screws 60.

A card like connector element 62 extends upwardly from the center of the bottom plate 58 within the housing 54. As shown in FIG. 5 this connector element is provided with a series of spaced apart holes 64, some of which are filled with a light transparent substance and others of which are filled with a light opaque substance. The particular arrangement of light transparent and light opaque holes forms a binary coding arrangement which identifies the station. Notches 64*a* and 64*b* are formed along the upper edge of the connector element 62. These notches are arranged to be in alignment with the connector switch photocells 42*a* and 42*b* and their respective pulsing light sources 40*a* and 40*b* when the connector element 62 is fitted into the slots 28 of the watchman's unit 18. It will be noted that the notches 64*a* and 64*b* do not exceed down to the level of the holes 64. These notches thus serve to prevent blocking of the light from the pulsing light sources 40*a* and 40*b* to their respective connector switch photocells 42*a* and 42*b* as the connector element 62 is initially being inserted into the unit 18.

The coding arrangement of the connector element 62 is not readily visible so that it is not susceptible to counterfeiting should a watchman wish to enter false data into the recorder unit. In addition the particular code for the station may be changed by removing the bottom plate and connector unit and replacing it with a new one. A wire 66 may be passed through holes in the screws 60 and fastened with a seal 68 to prevent surreptitious removal of the bottom plate and connector element.

In making a station check, the watchman's unit 18 is fitted into the box-like housing 54 at the station so that the connector element 62 fits into the station connector slot 28, so that the holes 64 become positioned between the light source 40 and the various photocells 42. When the connector element 62 is fully in position it interrupts light from the pulsing light sources 40*a* and 40*b* to their respective connector switch photocells 42*a* and 42*b*. The light source 40 is arranged to be turned on in response to the absence of light detection by the connector switch photocells 42*a* and 42*b* for a duration exceeding that of the light pulse interval of the pulsing light sources 40*a* and 40*b*. When the light source 40 is turned on, its light passes through those holes 64 in the connector element 62 which are fitted with a light transparent substance to energize the photocells 42 which are adjacent the light transparent holes. The remaining photocells, which are adjacent the light opaque holes, do not become energized. The pattern or arrangements of electrical outputs from the energized and non energized photocells corresponds to the station code; and this output is used for data recording in the watchman's unit.

Figure 6:
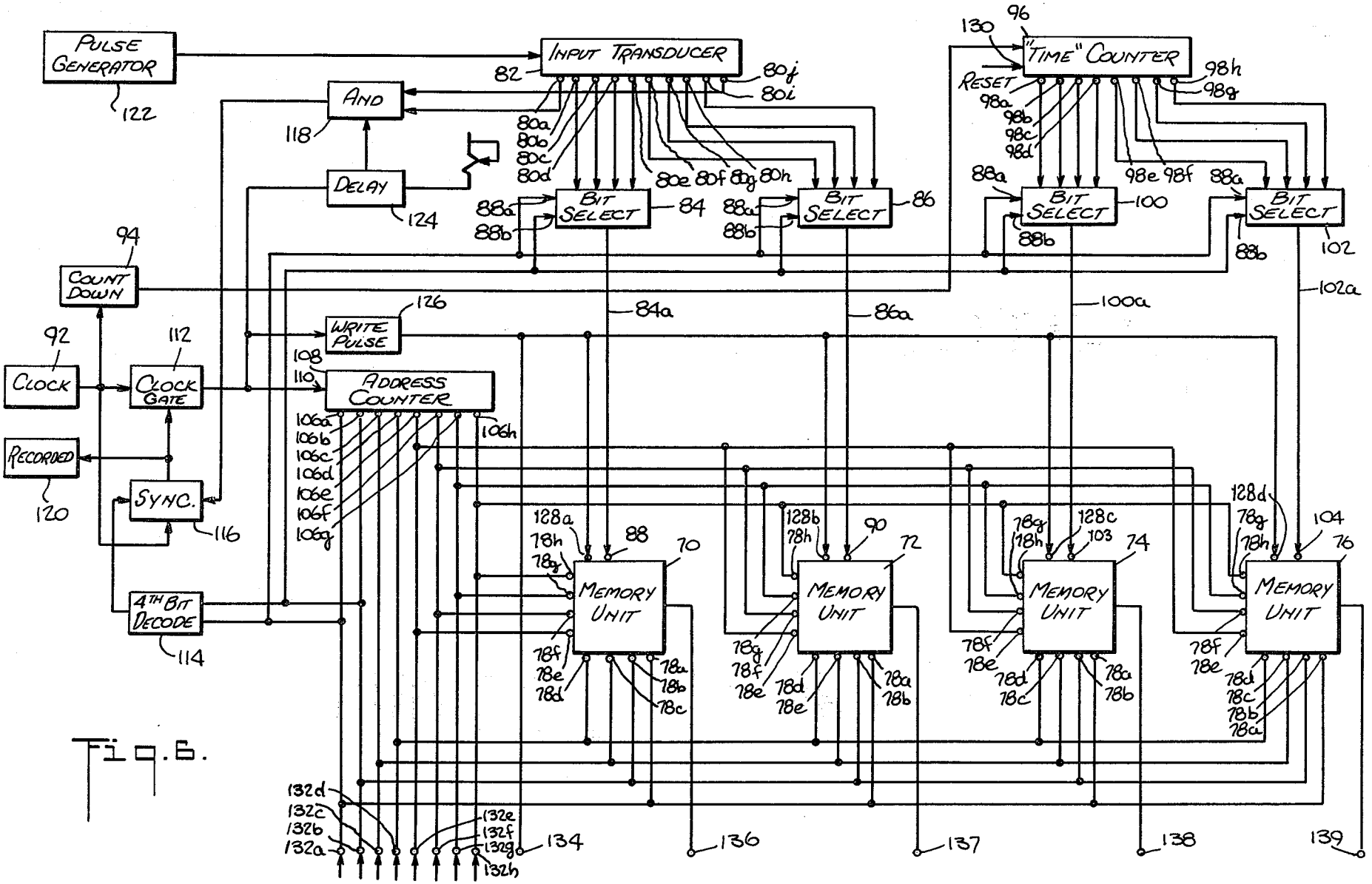
FIG. 6 is a block diagram showing the interior arrangement of components in the watchman's unit of FIG. 3.

FIG. 6 shows in block diagram form the arrangement of components within the watchman's unit. In the arrangement of FIG. 6 both station identification and time data signals are inserted into predetermined memory locations; however the full capacity of only four 256 bit memories is utilized in the recording of 64 station checks. Also with the arrangement of FIG. 6, the same station may be rechecked at different times during a tour and each check will be properly and unambiguously recorded in the storage means.

As shown in FIG. 6 there are provided four 256 bit memory units 70, 72, 74 and 76. Each memory unit includes eight address terminals 78*a* . . . 78*h* which control, according to the arrangement of signals applied thereto, the locations within the unit where data information is stored.

Station identification information is generated in binary coded digital form upon the connection of the watchman's unit to a check station, as described above. This information is presented in binary digital form at various outputs 80*b* . . . 80*i* of an input transducer 82. This transducer may, for example, include the photocells 42 of FIG. 3. The outputs from the transducer 82 are arranged into two groups 80*b* . . . 80*e* and 80*f* . . . 80*i* and are supplied, respectively, to bit select units 84 and 86. These bit select units each have two address terminals 88*a* and 88*b* and, depending on the particular arrangement of binary signals applied to these address terminals, the bit select units 84 and 86 will permit a different one of the applied outputs 80 to pass through to a single data input line 84*a* and 86*a* respectively. Actually, as will be seen, the binary signals are binary forms of successive counts from one to four so that the bit selections scan the outputs 80 and successively pass each of them through the selectors to their single output. The data input lines 84*a* and 86*a* are connected to data input terminals 88 and 90 of the two memory units 70 and 72.

Time data information is generated by means of a clock 92 which generates a continuous series of accurately spaced impulses. A binary counter or "Count Down Circuit" 94 receives these pulses and produces a predetermined submultiple thereof. These divided down pulses are applied to a time counter 96, which may be a multiple stage binary register or accumulator having a plurality of output terminals 98*a* . . . 98*h*. The pattern of energization of these terminals, as in the preceeding embodiments, represents the total accumulated pulse count from the divider 94; and this in turn corresponds to the elapsed time since the clearing of the time counter 96. The first four terminals 98*a* . . . 98*d* are connected to a third bit select unit 100 while the second four terminals 98*a* . . . 98*h* are connected to a fourth bit selector unit 102. These two bit selector units operate in the same manner to direct different ones of their applied signals through them to single output data lines 100*a* and 102*a* in accordance with binary signals applied to address terminals 88*a* and 88*b* thereon. These data lines are connected respectively to data input terminals 103 and 104 of the memory units 74 and 76.

The eight address terminals 78*a* . . . 78*h* of the memory units 70, 72, 74 and 76 serve to direct data signals from the bit select units 84, 86, 100 and 102 to particular ones of the 256 different locations within the memory units.

Corresponding ones of the address terminals of each of the memory units are connected to an associated output terminal 106*a* . . . 106*h* of an address counter 108. This address counter has an input terminal 110 connected through a clock gate 112 to the clock 92. As clock signals pass through the gate 112 they are accumulated in the address counter 108 and cause its output terminals 106*a* . . . 106*h* successively to change the pattern of their energization, thereby successively changing the bit locations within the memory units 70, 72, 74, and 76 which can receive and store data input signals. The address counter 108 is arranged to count in conventional binary form with the first terminal 106*a* corresponding to the least significant digit and the last terminal 106*h* corresponding to the most significant digit. The two least significant digit output terminals 106*a* and 106*b* of the address counter 108 are connected to corresponding address terminals 88*a* and 88*b* of each of the four bit selector units 84, 86, 100 and 102. It will be appreciated that as successive pulses are applied to the address counter 108 to step it through a complete address count sequence, the bit selectors, which are of a much smaller count capacity, recycle, i.e. scan through their selection range successively a number of times. It will further be appreciated that the address counter with its eight output terminals can produce a total of 256 different addresses, corresponding to the number of bit locations in each of the memory units 70, 72, 74 and 76. The bit selector units 84, 86, 100 and 102 on the other hand, are capable of accumulating only four counts, to direct their four applied inputs in succession to their single output. Thus, as 256 clock pulses are applied successively to the address counter 108, 64 4-bit words are successively transferred from the station identification input transducer 82 and the time counter 96 into each of the various memory units. Actually, the two memory units 70 and 72 cooperate by storing different halves of the 8-bit words constituting each complete station identification data signal, while the other two memory units 74 and 76 cooperate by storing different halves of the 8-bit words constituting each complete time data signal.

The two least significant bit output terminals 106*a* and 106*b* of the address counter 108 are also connected to a fourth bit decode counter 114 which produces a stop pulse for application to a "SYNCH" circuit 116 each time the address counter 108 has been stepped through four address changes. Signals from the clock 92 are also applied to the "SYNCH" circuit 116 and are used to control the clock gate 112.

The station input transducer 82 is provided with output terminals 80*a* and 80*j* connected to a start AND gate 118. Outputs from this gate are also applied through the "SYNCH" circuit 116 to the clock gate 112. A "Recorded" indicator light 120 is connected to the output of the "SYNCH" circuit 116 to record the insertion of data from the station input transducer 84 and the time counter 96 into their respective memory units 70, 72, 74 and 76. A pulse generator 122 is provided at the station input transducer to produce the signals applied to the AND gate 118. A delay circuit 124 is connected to the output of the clock gate 112; and this circuit serves to close the AND gate 118 for a duration at least as long as necessary to complete a station check. This serves to prevent anomolous readings from transients or other extraneous effects which might cause different signals to be applied through the station input transducer 84 while a station reading is being taken.

The output of the clock gate 112 is also applied to a "WRITE PULSE" circuit 126 which in turn is connected to write input terminals 128*a* . . . 128*d* of each of the memory units 70, 72, 74 and 76.

In operation of the above described system a reset pulse is applied to a reset terminal 130 of the time counter 96 to clear that counter at the start of a watchman's tour. As the watchman proceeds along his tour, the clock produces a continuous series of accurately timed pulses, and these pulses, as divided down by the "COUNT DOWN" circuit 94 are accumulated in the time counter 96. The pattern of energization of the time counter output terminals 98*a* . . . 98*h* which corresponds to elapsed time, is applied to the third and fourth bit select units 100 and 102.

When the watchman connects his unit to the first station to be checked, a pulse is generated by the pulse generator 122 and the station input transducer 82 is caused to energize its station identification terminals 80*b* . . . 80*i* in accordance with a binary digital code representative of the station identity. This code is applied to the terminals of the first and second bit select units 84 and 86.

The station input transducer also produces a signal via the AND gate 118 to a "START" terminal of the "SYNCH" circuit 116. This allows the next subsequent clock signal to pass through the "SYNCH" circuit and open the clock gate 112. The following clock signals then pass through the clock gate and step the address counter 108 also so that it successively addresses different storage locations in the four memory units 70, 72, 74 and 76. At the same time, and in synchronism with this address stepping, the signals from the least significant digit outputs 106*a* and 106*b* of the address counter 108 are applied to the four bit select units 84, 86, 100 and 102 causing them successively to transmit the signals present on each of their four inputs to different locations within the associated memory units 70, 72, 74 and 76.

When four clock pulses have occured, the bit select units will have scanned each of their four inputs. Also at this time, the fourth bit decode counter 114 will produce a signal at the "STOP" terminal of the "SYNCH" circuit 116 so that no further stepping of either the address counter or the bit select units will take place. During the stepping of these units, the clock pulses which pass through the clock gate 112 also activate the "WRITE PULSE" circuit 126. This circuit supplies pulses to write input terminals 128*a* . . . 128*d* at each of the memory units 70, 72, 74 and 76 to allow those units to accept information present on their respective data input terminals 88, 90, 103 and 104, and to store that data in locations corresponding to the signal pattern at their address terminals 78*a* . . . 78*h*.

It will be appreciated from the foregoing that it is possible with the system described herein to store correlated time and station identification data, each having 8-bit word lengths, into 256 bit memory units in such a manner that the memory units are used in a most efficient manner for maximum data storage capacity.

Information may be read out of the memory units when the watchman's unit is connected to a computer terminal board as in the case of the preceeding embodiments. In such case address interrogation signals are applied from the computer terminal board to address interrogation terminals 132*a* . . . 132*h* connected, respectively, to each of the memory unit address terminals. Write signals are also applied from the computer terminal board through a write input terminal 134 to the write input terminals 128*a* . . . 128*d* of the memory unit. Data outputs from the memory units are supplied via station identification and time data output terminals 136, 137, 138 and 139 respectively.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. A watchman's unit for recording correlated time and station identity information during a watchman's tour, said unit comprising clock signal means operable, upon connection of the unit to a station, to produce clock signals representative of elapsed time from the start of a tour, station identity signal means operative, upon connection of the unit to a station, to produce station signals representative of the identity of the station, clock signal storage means and station signal storage means for storing the signals produced by said clock signal means and said station identity signal means respectively, at least one of said signal means being operative to produce signals in the form of binary coded digital words each made up of a predetermined number of bits, the signal storage means associated with said one signal means having a plurality of digital bit storage elements at various locations therein for storing the bit data of a multiplicity of said digital words, address means connected to the signal storage means associated with said one signal means and operative sequentially to render different one of said digital bit storage elements receptive to applied digital bit data, and decoder means connected to the output of said one signal means and operative sequentially to transmit different bits of a binary coded digital word signal being produced to its associated signal storage means, said address means and said decoder means being arranged to be operated in synchronism.

2. A watchman's unit according to claim 1 wherein said one signal means includes a register having different stages for retaining said predetermined number of bits, said decoder means and said address means being arranged to be scanned in synchronism.

3. A watchman's unit according to claim 2 wherein said decoder means is connected to scan said register repeatedly during each scan of said address means.

4. A watchman's unit according to claim 1 wherein said address means comprises a counter having a count capacity equal to that of the signal storage means to which it is connected and wherein said counter has output terminals which become energized according to a pattern representative of the number of scanning pulses applied thereto, said output terminals being connected to said storage means to render said digital bit storage elements receptive to applied digital bit data according to the number of scanning pulses applied to said counter.

5. A watchman's unit according to claim 1 wherein said decoder is connected to selected output terminals of said address means.

6. A watchman's unit according to claim 1 wherein said address means becomes energized according to a binary counting sequence as successive scanning pulses are applied to it and wherein the outputs representative of the least significant digit of said digital bit data in said address means are connected to said decoder means in a manner such that the decoder produces an output on a single output line in accordance with the state of a stage therein corresponding to the pattern of energization of said least significant data outputs.

7. A watchman's unit according to claim 1 wherein said unit includes means for causing a series of scanning impulses of said predetermined number to be supplied to said address means in response to the connection of said unit to a station to be checked.

8. A watchman's unit according to claim 7 wherein said means for causing a series of scanning impulses includes said clock signal means.

9. A watchman's unit according to claim 1 wherein said decoder means includes plural decoder units each having inputs connected to different bit output terminals of said one signal means and wherein said storage means includes plural storage units each having a data input terminal connected to the output of a different one of said decoder units, said address means being connected to each of said plural storage units for simultaneous control of said units.

10. A watchman's unit according to claim 9 wherein said plural decoder units are connected to be operated simultaneously in synchronism with said address means.

11. A watchman's unit for recording correlated time and station identification information during a watchman's tour, said unit comprising a first signal storage means, a station input device responsive upon connection to a station to supply station identity signals to said first signal storage means, a second signal storage means having a first plurality of digital bit storage locations for storing information in binary digital code, digital clock means operative to produce a series of timed pulses, time data means comprising a register for accumulating said pulses and having a second plurality of output terminals which become energized according to patterns corresponding to the number of accumulated pulses, time data decoding means connected to said output terminals, said decoding means having a time data output terminal connected to said second signal storage means and operative in response to each of successively applied pulses to pass the signal present at a different one of the register output terminals through said time data output terminal for application to said second signal storage means, address means connected to said second signal storage means and operative in response to each of successively applied pulses to render a different one of said digital bit locations receptive to applied time data signals, and means for applying pulses to operate said time data decoding means and said address means in synchronism with each other in response to connection of said unit to a station.

12. A watchman's unit according to claim 11 wherein the first plurality of digital bit locations in said second signal storage means is a multiple of said second plurality of output terminals of said time data means register.

13. A watchman's unit according to claim 11 wherein said digital clock means is connected through a gate to said address means, means for opening said gate in response to the connection of said unit to a station to be checked and means for closing said gate in response to the passing therethrough of pulses equal in number to said second plurality.

14. A watchman's unit according to claim 11 wherein said second signal storage means comprises a plurality of memory units each having a number of digital bit locations.

15. A watchman's unit according to claim 11 wherein said station input device comprises means having a plurality of station identification terminals equal in number to said second plurality and means for energizing said station identification terminals according to a binary digital code representative of the identity of a station to which the watchman's unit is connected.

16. A watchman's unit according to claim 15 wherein said first signal storage means also has a number of digital bit storage locations equal in number to said first plurality and wherein further data decoding means are connected to said station identification terminals, said further data decoding means having a station identification data output terminal connected to said first signal storage means.

17. A watchman's unit according to claim 16 wherein a further address means is connected to said first signal storage means, said further address means connected to be operated in response to each of said successively applied pulses.

18. A watchman's unit according to claim 17 wherein said further data decoding means is connected to be scanned in synchronism with said further address means.

19. A watchman's unit according to claim 18 wherein said time data decoding means and said further data decoding means have equal numbers of inputs.

* * * * *